United States Patent [19]

Snellman et al.

[11] 3,949,982

[45] Apr. 13, 1976

[54] ARTICULATED ARM SHEET JOGGING MECHANISM

[75] Inventors: Donald L. Snellman; Wade C. Vaughn; Marvin H. Haapala, all of Seattle, Wash.

[73] Assignee: Norfin, Inc., Seattle, Wash.

[22] Filed: Dec. 2, 1974

[21] Appl. No.: 528,655

[52] U.S. Cl. ..... 271/222

[51] Int. Cl.[2] ..... B65H 31/38

[58] Field of Search ..... 271/64, 173, 221, 222

[56] References Cited

UNITED STATES PATENTS

| | | | |
|---|---|---|---|
| 1,421,868 | 7/1922 | Volkmere | 271/221 |
| 2,027,341 | 1/1936 | Hornbeck et al. | 271/221 |
| 3,388,907 | 6/1968 | Snellman et al. | 271/222 |
| 3,658,324 | 4/1972 | Snellman | 271/222 |

*Primary Examiner*—John J. Love
*Assistant Examiner*—Robert Saifer
*Attorney, Agent, or Firm*—Dowrey & Cross

[57] ABSTRACT

The sheet jogging mechanism is comprised of a pivotally movable articulated arm including pivotally interconnected forward and rear arm sections. As the rear arm section is swung toward the side of a loosely formed stack of sheets, the forward arm section is moved progressively from a parallel to a convergent orientation relative to the side of the sheet stack until a jogging rod mounted on the front end thereof engages one side of the sheet stack. As the rear arm section is swung further toward the sheet stack, the forward arm section pivots relative thereto and toward the side of the sheet stack until again assuming a parallel orientation relative to the sheet stock so as to bring a second jogging rod mounted on the rear end thereof into engagement with the one side of the sheet stack. Lateral jogging is accomplished by driving the other side of the stack against a back-stop, or by simultaneously swinging together two or more mutually opposed articulated arms with jogging rods contacting opposite sides of the stack. For lengthwise sheet alignment, a reciprocally movable back bar simultaneously engages the rear end of the sheet stack. The sheet jogging mechanism is suitable for simultaneously jogging a plurality of sheet stacks deposited within vertically spaced receiving bins of a sheet sorter.

22 Claims, 9 Drawing Figures

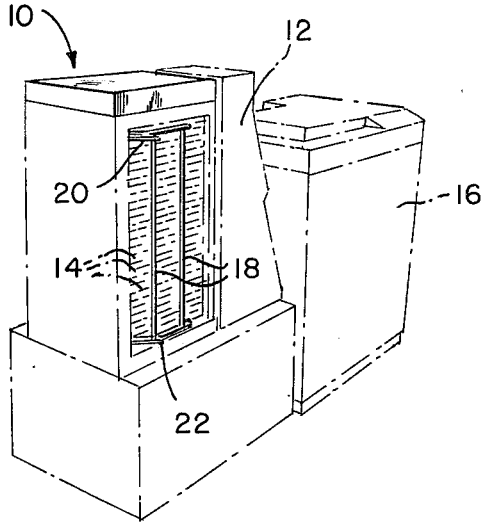
FIG. 1
FIG. 2
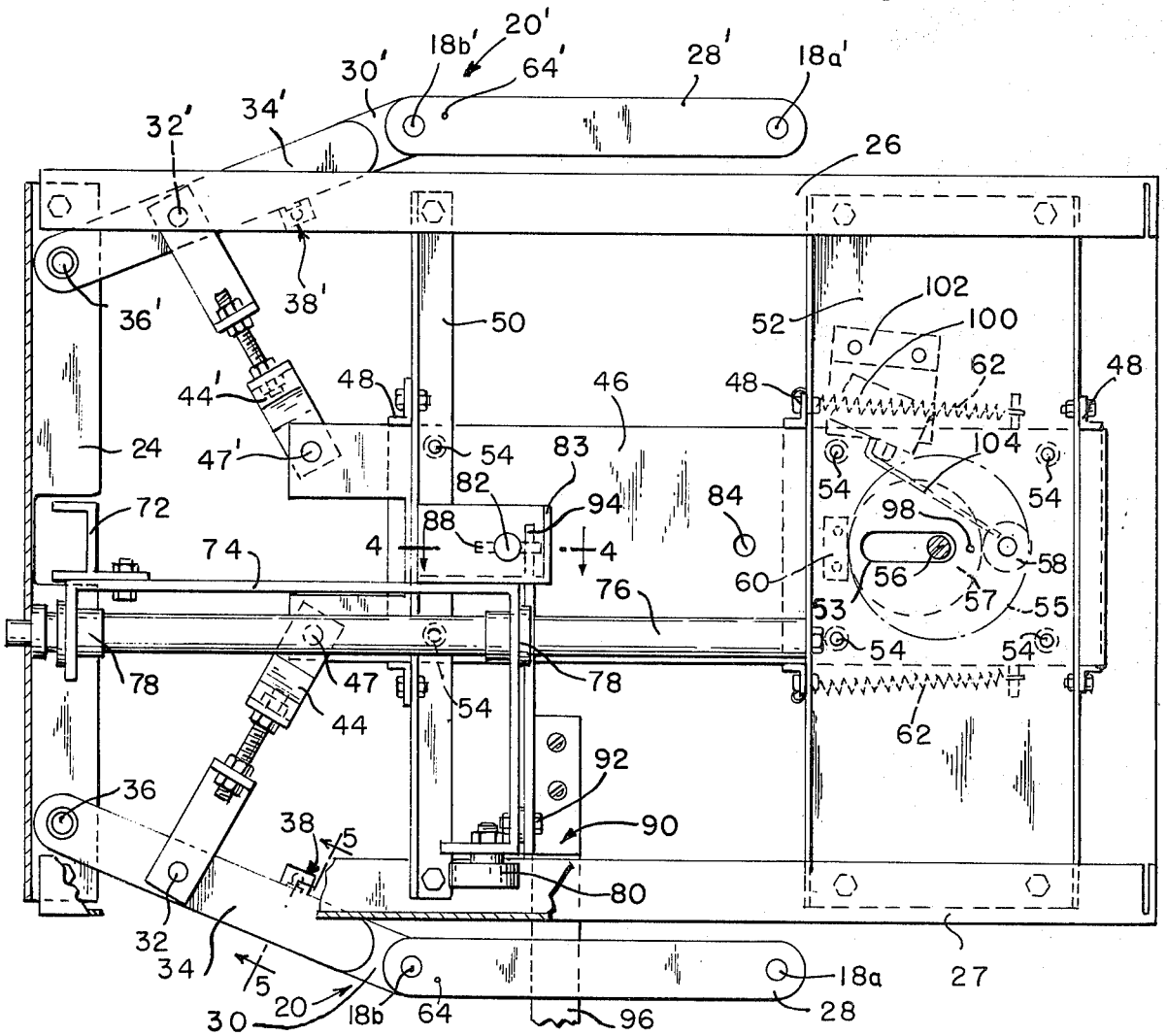

ARTICULATED ARM SHEET JOGGING MECHANISM

BACKGROUND OF THE INVENTION

This invention relates to sheet stack formers for tapping or jogging a loosely formed stack of sheets to form an even stack. More particularly, the invention relates to a jogging mechanism for simultaneously jogging a plurality of loosely formed sheet stacks once they have been deposited in an array of vertically spaced receiver bins of a sheet sorter or the like.

Typical sheet jogging mechanisms include two or more opposed jogging rods pivotally mounted to swing or rock to and from a jogging position in which they extend in spaced mutually parallel lines adjacent the sides of the sheets. As the opposed jogging rods are swung or rocked to their jogging positions, they simultaneously engage or tap the sides of and thus even the loosely stacked sheets therebetween. Several sheet jogging mechanisms have been devised for moving the jogging rods in this manner; however, such mechanisms and linkages have been complex and reliability has been a problem. Thus, the need exists for a simple, highly reliable mechanism for moving the jogging rods in unison while maintaining desired mutual parallelism of the jogging rods at the jogging position and, hence, accurately aligning the edges of the sheets in the stack or stacks.

SUMMARY OF THE INVENTION

This invention provides a simple, highly effective jogging mechanism for moving a plurality of jogging rods into substantially simultaneous lateral engagement with one or more loosely formed stacks of sheets. The invention is adapted for use in combination with a bin or shelf to laterally tap or jog either or both sides of a plurality of sheets loosely stacked on the shelf, so as to form an even stack thereon. For better sheet stack alignment, this invention may also provide lengthwise alignment of the sheets by jogging the rear ends of the sheets. The jogging mechanism of this invention is particularly suitable for use with an "in line" sorter of the type in which a series of sheets is delivered from a copier, printing press, or the like and then distributed sequentially to an array of vertically spaced sorter receiving bins.

According to a preferred embodiment of this invention, the jogging mechanism comprises two or more mutually opposed, pivotally mounted articulated arms, each of which supports several jogging rods. Preferably there are four arms arranged in two adjacent, conjointly movable pairs on opposite sides of the shelves or sheets, although a single arm or pair of arms disposed on one side of the shelves or sheets may be used in cooperation with means providing a stop against which the opposite sides of the sheets can be aligned. Each arm is made up of pivotally interconnected forward and rear arm sections. Two jogging rods are supported by each forward arm section; however, additional jogging rods may be provided, if desired.

The forward arm sections initially are substantially parallel with their opposite counterparts and with the sides of the shelves or sheets when the rear arm sections are at their maximum averted positions. As the opposed rear arm sections are swung together pivotally, however, the opposed forward arm sections become progressively mutually convergent until their respectively associated forward jogging rods engage the sides of the sheets therebetween. Thereafter, as the opposed rear arm sections are swung further together, the opposed forward arm sections pivot relative to their respective rear arm sections and toward each other until again assuming mutually parallel positions at which the rear jogging rods also contact the sheets to thereby jog the sheets. While the opposed articulated arms are preferably swung together to jog the sheet stacks only once during a sheet distribution cycle or after all the receiving bins have been filled completely, the sheet stacks may be jogged once as each sheet is deposited in a bin, or they may be jogged several times to insure complete evening of the sheets, if desired. One or both articulated arms can be disabled and moved to a retracted position removed from the receiver bins without interfering with operation of the other arm or the sorter.

The opposed articulated arms are swung together by a powered reciprocal jogging plate pivotally connected with the rear arm sections thereof. The other arms, if any, are drawn together conjointly with the two powered arms. For more effective jogging of the sheet stacks, a back bar may be connected with the jogging plate to be moved reciprocally to and from a rear jogging position in which the back bar taps or jogs the rear ends of the sheets.

These and other objects, features and advantages of this invention will become apparent in the detailed description and claims to follow taken in conjunction with the accompanying drawings in which like parts bear like reference numerals in the various views.

BRIEF DESCRIPTION OF THE DRAWINGS

FIG. 1 is a perspective view of a copier and a sorter with which the articulated arm sheet jogging mechanism of this invention may be used;

FIG. 2 is a top view of the sheet jogging mechanism of FIG. 1 with parts broken away;

DETAILED DESCRIPTION OF THE PREFERRED EMBODIMENT

Figure 3:
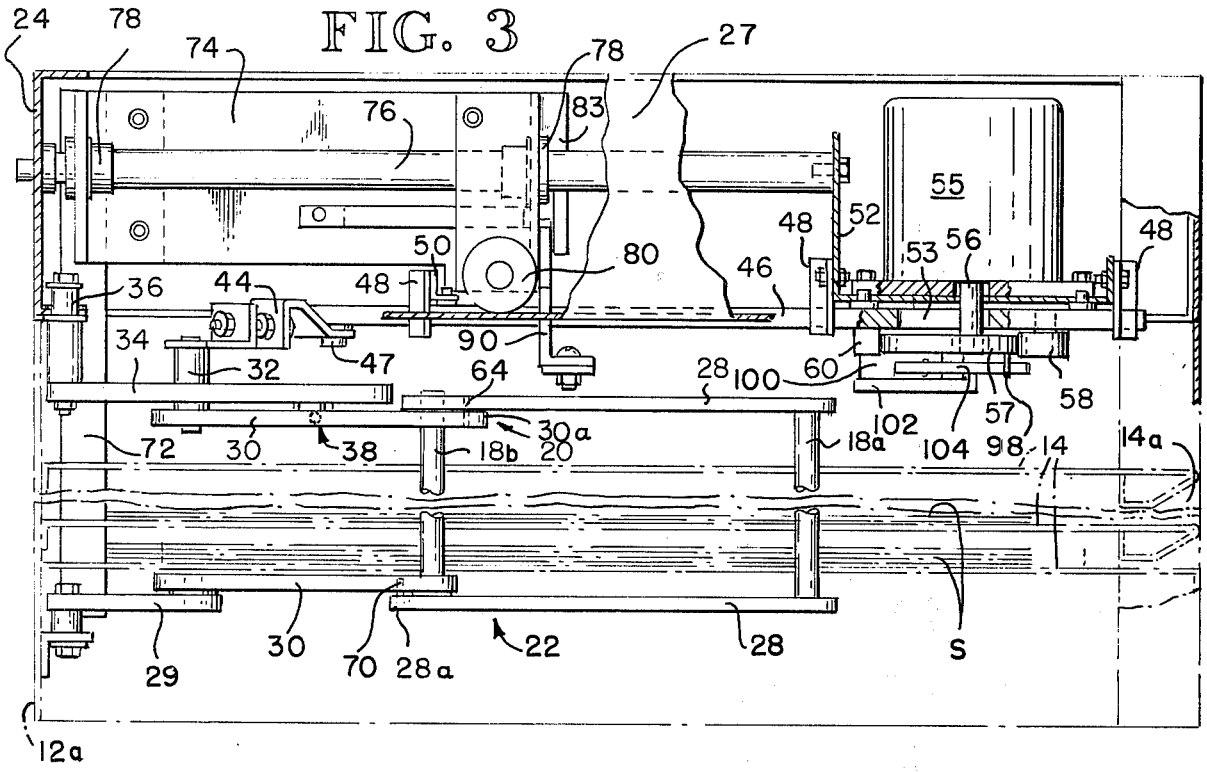
FIG. 3 is a side view of the sheet jogging mechanism of FIG. 1 with parts broken away.

In the example of FIG. 1, a sheet jogging unit 10 is mounted on the top of the receiver section of a sorter 12 including an array of vertically spaced open sided receiving bins 14 into which individual sheets S (FIG. 3) are deposited sequentially and in predetermined numbers through forwardly facing rectangularly outlined openings 14a (FIG. 3) after being fed from a copier 16 or like device. The sheets are accumulated in loosely formed uneven stacks upon the flat bottoms or shelves of the sorter bins 14. At termination of sheet feeding, the sheet jogging unit 10 brings four vertical jogging rods, two of which are indicated generally at 18 in FIG. 1, arranged two on each side of the sorter bins 14, into engagement with the sides of the accumulated sheets which are thereby placed simultaneously in neat, even stacks within the sorter bins 14. The jogging rods thereafter can be moved away from the sorter bins 14 to allow removal of the sheet stacks through the open sides of the sorter bins. Articulated upper and lower arms 20 and 22 pivotally support the jogging rods 18 from the sheet jogging unit 10. The opposite articulated arms including their pivotal connections and operating linkages not shown in FIG. 1 are mirror images of those shown and are designated hereinafter with primed reference numerals for clarity. The opposed arms simultaneously swing toward and away from each other parallel to the bottoms or shelves of the sorter bins 14.

Referring now in particular to FIGS. 2 and 3, the sheet jogging unit 10 comprises a generally rectangular housing including U-shaped rear end 24 and left and right sides 26 and 27 respectively. The front end of the sheet jogging unit housing is open to provide access for electrical and mechanical connections with the sorter 12. The housing rear end and sides 24, 26 and 27 are secured to respective upper edges of the sorter rear and side walls. The right and left upper arms 20 and 20', as viewed in FIG. 2, are pivotally supported from the jogging unit housing rear end 24 and project underneath and outwardly from the associated sides of the jogging unit housing. As shown in FIG. 3, the right and left lower arms 22 and 22' (left lower arm not shown in FIG. 3) are pivotally supported from the rear wall 12*a* of the sorter by pivotally movable brackets 29 at a location below the sorter bins 14.

Each articulated arm includes forward and rear pivotally interconnected arm sections 28 and 30 respectively. Two jogging rods 18*a* and 18*b* are respectively connected between the upper and lower forward arm sections at the front and rear ends thereof on each side of the sorter bins 14 and extend vertically the height of the sorter bin array. The rear jogging rods 18*b* also are connected between the front ends of the upper and lower rear arm sections 30 and serve as pivot pins about which the forward and rear arm sections can swing relative to each other. Two or more jogging rods, of course, may be mounted between the upper and lower forward arm sections. As will be appreciated, the number and spacing of the jogging rods may vary depending on desired alignment of the sheet stacks and other factors.

Figure 5:
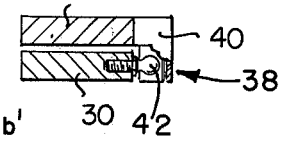
FIG. 5 is a cross section taken along lines 5—5 in FIG. 2.

The pivotal mounting for the right and left upper arms 20 and 20' is best described with reference to FIGS. 2, 3 and 5. The rear upper arm sections 30 are pivotally dependedly mounted by vertical pivot pins 32 from outer links 34 which in turn are pivotally mounted by vertical pivot pins 36 upon the rear end 24 of the housing. The rear upper arm sections and their respectively associated outer links are detachably interconnected by snap couplings 38 so as to pivot conjointly in superimposed relationship about the rear pivot pins 36. Referring now to FIG. 5, each upper arm snap coupling 38 includes a vertical connecting block 40 extending between the inner edge of the outer link 34 and rear arm section 30. The connecting block 40 is fixed to the inner edge of outer link 34 and is detachably secured to the inner edge of the rear arm section by a snap fastener 42. By detaching one or both snap fasteners on the articulated arms, one or both pairs of arms can be swung away from the sheet jogging unit as depicted in broken lines *a* in FIG. 9, so as to be disabled, without interferring with operation of the other pair of arms, the sheet jogging unit 10 or the sorter.

Variable length inner links 44 (FIGS. 2 & 3) connect the outer links 34 with adjacent bifurcated rear ends of a reciprocable jogging plate 46. The inner links are pivotally connected at opposite ends with the arm pivot pins 32 and jogging plate pivot pins 47.

The jogging plate 46 is slidably supported by three U-shaped brackets 48 respectively depending from a rear transverse housing support 50 and the rear and front edges of a forward motor mounting bracket 52. The housing support 50 and the motor mounting bracket 52 are secured at their ends with the housing sides 26 and 27. Nylon or teflon slides 54 projecting through these supports engage the upper surface of the jogging plate to provide low friction bearing surfaces.

A motor 55 secured to the upper surface of the motor mounting bracket 52 includes a drive shaft 56 which projects downwardly through a vertically aligned opening in the motor mounting bracket 52 and a slot 53 in the jogging plate 46. An eccentric cam 57, fixed to the end of the motor drive shaft 56, slidably engages a cam follower roller 58 rotatably mounted on the underside of the jogging plate 46 forwardly of the jogging plate opening 53. A cam follower block 60 is secured to the underside of the jogging plate at the opposite end of the slot 53 from the cam follower roller 58. Springs 62 (FIG. 2), connected between the jogging plate 46 and the intermediate jogging plate support bracket 48, bias the jogging plate rearwardly.

Figure 9:
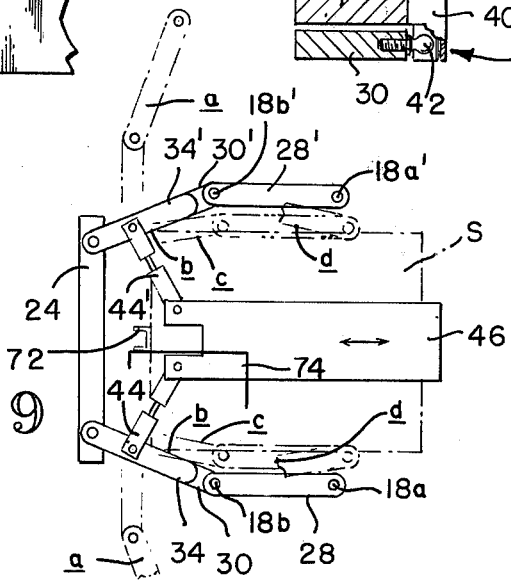
FIG. 9 is a schematic depicting operation of the sheet jogging mechanism of FIG. 1.

Jogging plate 46 alternately is driven forwardly as the eccentric cam 57 is rotated by the motor 55 to engage the cam follower roller 58 and then is returned rearwardly under the influence of springs 62. If these springs should fail, or are eliminated, the eccentric cam 57 will engage the cam follower block 60 and thus returns the jogging plate. This reciprocal movement of the jogging plate 46 is transmitted to the rear arm section 30-30' by the associated links 34, 44 causing the arms 20-20' to swing alternately and simultaneously toward and away from each other, as depicted in FIG. 9. The lower arms 22 and 22', connected to the upper arms by rods 18*a*, 18*b*, of course, swing conjointly therewith.

Figure 6:
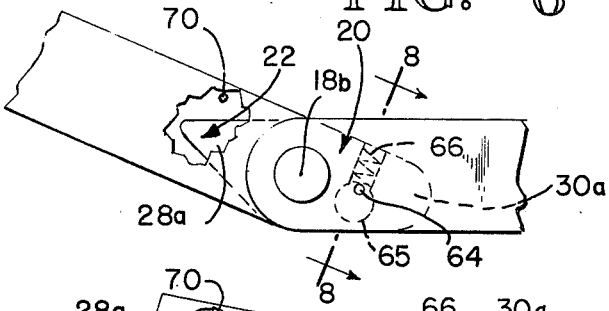
FIGS. 6 and 7 are fragmentary top views with parts broken away on expanded scale and in more detail of the interconnected end portions of the upper and lower right articulated arms of the sheet jogging mechanism of FIG. 1.
Figure 8:
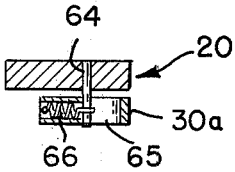
FIG. 8 is a cross section taken along lines 8—8 of FIG. 6.
Figure 7:
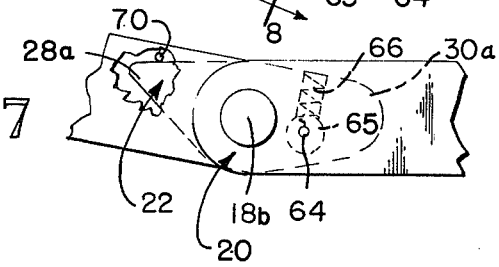

The pivotal connections between the forward and rear sections of the upper and lower right articulated arms 20 and 22 are illustrated in FIGS. 6–8. (The opposite or left side articulated arms are similarly interconnected and are not described separately herein.) As most clearly shown in FIG. 8, a vertical connecting pin 64 (see also FIG. 3) depending from the forward arm section associated with the right upper arm 20 projects into a slot 65 in a generally triangular upper shoulder 30*a* projecting forwardly from the rear arm section of the same arm and is connected therein with one end of a tension spring 66 secured at its other end to the upper shoulder 30*a*. The bias of this spring swings the upper and lower arm sections about the rear jogging rod 18*b* therebetween until connecting pin 64 abuts against the inner edge of the upper shoulder slot 65, as depicted in FIG. 6, giving the upper and lower arms a bent configuration.

In this bent arm configuration, the forward arm sections of all four articulated arms 20, 20', 22 and 22' are parallel to the sides of the sheets S and to their opposite counterparts when their respectively associated rear arm section 30-30' are in their averted positions, depicted in solid lines *b* in FIG. 9. The lengths of the inner links 44-44', of course, can be varied to adjust the orientation of the forward arm sections 28 relative to the sheets S, or to accomodate sheets of varying width. As the opposed rear arm sections 30 are swung together, however, the opposed arms are maintained in the bent configuration by springs 66 and pins 64 so that their forward arm sections 28 and 28' become progressively mutually convergent until the forward jogging rods 18*a* engage the sides of the sheets S, as depicted in broken lines *d* in FIG. 9. Thereafter, as the opposed rear arm sections 30 are swung further together, until reaching their fully convergent positions *c* in which their forward ends are adjacent the sides of the sheets S, the opposed forward arm sections 28-28' pivot relative to their respective rear arm sections 30-30' against the bias of the tension springs 66 until rear jogging rods 18*b* also engage the sides of sheets S, as shown at dotted line arm position *c* in FIG. 9. This relative pivotal movement of the opposed forward and rear arm sections 28-28' and 30-30' is terminated when generally triangular lower shoulders 28*a* (FIG. 7) projecting rearwardly from the forward arm sections of the lower arms 22 and 22' abut against limit pin stops 70 (see also FIG. 3) upstanding from the rear arm sections of the same arms. (It will be understood that the lower arms on the opposite side of the machine are equipped with identical shoulder 28*a* and pin 70 arrangement.)

The arms now have a straightened configuration (see FIG. 7), and the opposed forward arm sections 28-28' are again parallel to each other and to the sheet sides, as depicted in broken lines *c* in FIG. 9. Thus, the opposed jogging rods 18*a* and 18*b* now extend in mutually parallel lines along and simultaneously engage opposite sides of the sheets S and are maintained in this position by shoulders 28*a* and pins 70 so that, upon further swinging movement of the rear arm sections 30-30'' toward one another, sheets S are placed by jogging rods 18*a* and 18*b* into neat, even stacks. The strength of tension springs 66 may be varied, of course, in accordance with desired lateral tapping or engaging force to be applied to the sheet sides by the jogging rods, 18*a*, *b*.

The articulated arms of the invention serve primarily to laterally jog the sheets S in the respective sorter bins 14 and to this end they are highly effective. However, this invention provides additional stack jogging along the length of the sheets by using a reciprocal U-shaped vertical back bar 72 (FIGS. 2 and 3) to tap or engage the rear edge of the sheets S simultaneously with lateral engagement by the jogging rods 18*a*, *b*. It will be recognized that the jogging rods 18*a*, *b* and the back bar 72 also serve to guide the sheets S into their respective sorter bins 14.

The back bar 72 is secured to the rear end of a generally L-shaped carriage plate 74 which is slidably mounted on a horizontal guide rod 76. Nylon or teflon tubular bearings 78 provide low friction movement of the carriage plate 74 along the guide rod 76. A wheel 80 rotatably secured to the laterally directed leg of the carriage plate 74 rolls along the lower lip of the right side 27 of the housing and supports carriage plate 74 as it moves back and forth along the guide rod 76.

The carriage plate 74, and hence the back bar 72, move conjointly with the jogging plate 46. The carriage plate is detachably secured to the jogging plate by a latch pin 82 (FIG. 2), the lower end of which is engaged in one of a series of holes 84 (FIG. 2) in the jogging plate. The relative positions of the back bar 72 and the rear ends of the sheets may be varied by selectively engaging the latch pin with one of the jogging plate holes 84. Thus, the jogging mechanism can be adjusted to accommodate sheets of different lengths.

Figure 4:
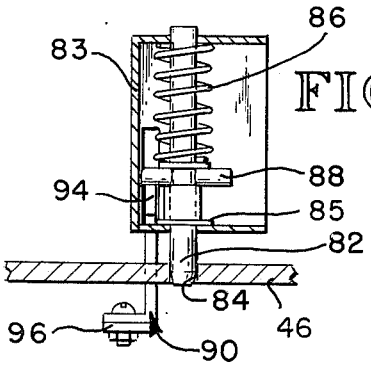
FIG. 4 is a cross section taken along lines 4—4 in FIG. 2 on expanded scale and in more detail.

As best shown in FIGS. 2 and 4, the latch pin 82 is slidably supported for vertical movement between opposed holes in the top and bottom of a rectangular housing 83 secured to the carriage plate 74. The pin is biased to an extended position at which a stop washer 85 engages the housing by a spring 86 held between the top of the latch pin housing 83 and a transverse pin 88 through the latch pin 82. A generally S-shaped latch release bracket 90 pivotally secured by an intermediate pivot pin 92 (FIG. 2) to the carriage plate 74 terminates at its inner end in a finger 94 which projects underneath and is engageable with the transverse pin 88. The other end of the latch release bracket projects laterally outwardly from the right side 27 of the housing and terminates in an actuator handle 96. In order to disengage the latch pin 82 from a jogging plate hole 84, the latch pin 82 is raised by depressing the latch release actuator handle 96.

As stated hereinabove, the motor 55 and eccentric cam 57 produce reciprocal motion of the jogging plate 46. The number of times the jogging plate is reciprocated to jog the end and sides of the sheet stacks may vary, of course, depending upon the type of sorter with which the invention is used, the nature of the sheets to be stacked and other factors. For example, one effective mode of operation of the jogging plate 46 is to reciprocate it once after all the sorter bins 14 are filled completely. To this end, an actuating pin 98 (FIGS. 2 and 3) depends from the eccentric cam 57. A stop switch 100 is mounted on an L-shaped plate 102 secured to the underside of the motor mounting bracket 52. The stop switch 100 includes a contact arm 104 which is engaged once by the actuating pin 98 during every revolution of eccentric cam 57. The stop switch 100 is connected in the jogger motor control circuit (not shown) and when operated by the actuator pin 98 causes the motor 55 to be de-energized after one revolution.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

What is claimed is:

1. A sheet jogging mechanism for aligning the edges of sheets in a stack, comprising in combination: articulated arm means including sheet edge contact means thereon, said sheet edge contact means having forward and rear contact portions, means mounting said arm means to swing between a first position at which said sheet edge contact means engage the sheet edges of one side of the sheet stack and a second position at which said arm means avert from the one side of sheet stack, backup means providing a stop against which the opposite edges of the sheets are aligned, said arm means including pivotally interconnected forward and rear arm sections, and means acting between said arm sections adjacent the pivot thereof for positioning said forward arm section substantially parallel to the one side of the sheet stack when said arm means are at their first and second positions and for controlling relative pivotal movement of said arm sections such that the forward sheet edge contact portion engages the sheet edges of the one side of the sheet stack as said arm means swing toward their first position and then the forward and rear sheet edge contact portions simultaneously engage the sheet edges of the one side of the sheet stack when said arm means reach their first position.

2. The sheet jogging mechanism of claim 1, wherein said articulated arm means constitute first articulated arm means and said backup means comprise second articulated arm means including second sheet edge contact means thereon, said second sheet edge contact means having forward and rear contact portions, means mounting said second articulated arm means to swing between a first position at which said second sheet edge contact means engage the sheet edges of the opposite side of the sheet stack substantially simultaneously with engagement of the sheet edges of said one side of the sheet stack by the first mentioned sheet edge contact means and a second position at which said second articulated arm means avert from the opposite side of the sheet stack, said second articulated arm means including pivotally interconnected foward and rear arm sections, and means acting between said second arm sections adjacent the pivot thereof for positioning said second forward arm section substantially parallel to the opposite side of the sheet stack when said second articulated arm means are at their first and second positions and for controlling relative pivotal movement of said second arm sections such that the second forward sheet edge contact portion engages the sheet edges of the opposite side of the sheet stack as said second arm means swing toward their first position and then said second forward and rear sheet edge contact portions simultaneously engage the sheet edges of the opposite side of the sheet stack when said second arm means reach their first position.

3. The sheet jogging mechanism of claim 2 further comprising; biasing means acting between the forward and rear arm sections respectively associated with said first and second articulated arm means to normally bias the arm sections to bent configurations in which said forward arm sections are substantially parallel to the sides of the sheet stack when the associated arm means are in their second positions.

4. The sheet jogging mechanism of claim 2 including; jogging operator means including a reciprocal motion transmitting means and linkage means connecting said motion transmitting means with the rear arm sections of said first and second articulated arm means for simultaneous movement of the arms between said first and second positions.

5. The sheet jogging mechanism of claim 4 including; sheet stack end contacting means located adjacent the end edges of the sheets in the stack, means mounting said sheet stack end contacting means for movement into and out of contact with the sheet ends, and linkage means connecting said end contacting means with said motion transmitting means for simultaneous movement with said first and second articulated arm means such that the sides and one end of said sheet stack can be simultaneously jogged.

6. The sheet jogging mechanism of claim 4 wherein; the linkage means connecting the first and second rear arm sections with said motion transmitting means includes detachable coupling means for selectively deactivating one or both of said first and second articulated arm means.

7. The sheet jogging mechanism of claim 2 wherein said first and second articulated arm means constitute upper articulated arms and including vertically spaced lower articulated arms associated therewith, said sheet edge contact means comprising a plurality of vertically extending jogging rods extending between the respective upper and lower articulated arms.

8. The sheet jogging mechanism of claim 1 including; reciprocating sheet stack end contacting means for engaging the end of the sheet stack substantially simultaneously with engagement of the one side of the stack by said sheet edge contact means.

9. In combination with a sheet receiving shelf adapted to receive a plurality of sheets to form a stack, a sheet jogging mechanism for aligning the edges of the sheets, comprising: articulated arm means including sheet edge contact means thereon, means mounting said arm means adjacent one end of the said shelf to swing between a first position at which said sheet edge contact means engage the sheet edges of the one side of the sheet stack and a second position at which said arm means avert from the one side of the sheet stack, backup means providing a stop against which the opposite edges of the sheets are aligned, means mounting said backup means adjacent the one end of said shelf, said arm means including pivotally interconnected forward and rear arm sections, and means acting between said arm sections adjacent the pivot thereof for positioning said forward arm section substantially parallel to the one side of the sheet stack when said arm means are at their first and second positions and for controlling relative pivotal movement of said arm sections such that only the forward sheet edge contact portion engages the sheet edges of the one side of the sheet stack as said arm means swing toward their first position and then the forward and rear sheet edge contact portions simultaneously engage the sheet edges of the one side of the sheet stack when said arm means reach their first position.

10. The combination of claim 9, wherein said articulated arm means constitute first articulated arm means, and wherein said backup means comprise second articulated arm means including second sheet contact means thereon, said second sheet edge contact means having forward and rear contact portions, means mounting said second articulated arm means adjacent the one end of said shelf to swing between a first position at which said second sheet edge contact means engage the sheet edges of the opposite side of the sheet stack substantially simultaneously with engagement of the sheet edges of the one side of the sheet stack by the first mentioned sheet edge contact means and a second position at which said second articulated arm means avert from the other side of the sheet stack, said second articulated arm means including pivotally interconnected forward and rear arm sections, and means acting between said second arm sections adjacent the pivot thereof for positioning said second forward arm section substantially parallel to the other side of the sheet stack when said second articulated arm means are at their first and second positions and for controlling relative pivotal movement of said second arm sections such that the second forward sheet edge contact portion engages the sheet edges of the opposite side of the sheet stack as said second arm means swing toward their first position and then said second forward and rear sheet edge contact portions simultaneously engage the sheet edges of the opposite side of the sheet stack when said second arm means reach their first position.

11. The combination of claim 10 further comprising biasing means acting between the forward and rear arm sections respectively associated with said first and second articulated arm means to normally bias the arm sections to bent configurations in which said forward arm sections are substantially parallel to the sides of the sheet stack when their associated arm means are in their second positions.

12. The combination of claim 10 including jogging operator means including a reciprocal motion transmitting means, and linkage means connecting said motion transmitting means with the rear arm sections of said articulated arm means for simultaneous movement of the arms between said first and second positions.

13. The combination of claim 12, including sheet stack end contacting means located adjacent the end edges of the sheets in the stack, means mounting said sheet stack end contacting means adjacent the one end of the said shelf for movement into and out of contact with the sheet ends, and linkage means connecting said end contacting means with said motion transmitting means for simultaneous movement with said articulated arm means such that the sides and one end of said sheet back can be simultaneously jogged.

14. The combination of claim 12 wherein the linkage means connecting said first and second rear arm sections with said motion transmitting means includes detachable coupling means for selectively deactivating one or both said first and second articulated arm means.

15. The combination of claim 10 further comprising a plurality of vertically spaced shelves each adapted to receive a plurality of sheets to from a stack, and wherein said first and second articulated arm means each comprises upper and lower articulated arms respectively adjacent the uppermost and lowermost shelves, said first-mentioned and second sheet edge contact means each comprising a plurality of jogging rods extending vertically between their respective upper and lower articulated arms such that they simultaneously jog the sheets in all of said shelves when said first and second articulated arms are at their first positions.

16. The combination of claim 9 including reciprocating sheet stack end contacting means for engaging the end of the sheet stack substantially simultaneously with engagement of the one side of the stack by said sheet edge contact means.

17. A sheet jogging mechanism for aligning the edges of the sheets in a stack comprising: first and second mutually opposed articulated arms each including pivotally interconnected forward and rear arm sections, jogging means having forward and rear contact portions mounted by said forward arm sections, means pivotally mounting said rear arm sections to swing substantially simultaneously relatively toward and away from each other between a first position at which they converge with each other and a second position at which they avert from each other, and means acting between the arm sections of said first and second arms adjacent the pivots thereof for positioning said forward arm sections in substantially mutually parallel relationship when said rear arm sections are at their first and second positions and for controlling relative pivotal movement of the arm sections such that said forward contact portions first engage sheet edges on opposite sides of the sheet stack as said rear arm sections are swung toward their first positions and then said forward and rear contact portions simultaneously engage sheet edges on opposite sides of the sheet stack when said rear arm sections are at their first positions.

18. The sheet jogging mechanism of claim 17, wherein said forward arm sections become progressively mutually convergent as said rear arm sections are moved from their second to their first positions, said forward arm sections further being pivotally movable to swing relatively toward each other as said forward contact portions engage the sides of the sheets until said forward arm sections are again substantially mutually parallel when said rear arm sections reach their first positions, to thereby cause said forward and rear contact portions to simultaneously engage opposite sides of the sheet stack.

19. A sheet jogging mechanism for aligning the edges of sheets in a stack, comprising: an articulated arm including pivotally interconnected forward and rear arm sections; sheet edge contact means including forward and rear contact portions mounted by said forward arm section, means for mounting said rear arm section to swing toward a jogging position adjacent one side of the sheet stack; arm control means actiing between said arm sections for controlling relative pivotal movement thereof such that said forward contact portion first engages the sheet edges of the one side of the sheet stack as said rear arm section is swung toward said jogging position, and then said forward and rear contact portions simultaneously engage the sheet edges of the one side of the sheet stack when said rear arm section reaches said jogging position, to thereby align the sheet edges of the one side of the sheet stack; and backup means providing a stop against which the sheet edges of the opposite side of the sheet stack are aligned.

20. The sheet jogging mechanism of claim 19, wherein said arm control means include means acting between said arm sections for limiting relative pivotal movement thereof such that said forward arm section (1) is prevented from swinging away from the one side of the sheet stack as said rear arm section is swung toward its jogging position, and (2) is prevented from swinging relative to said rear arm section when said rear arm section reaches its jogging positions.

21. The sheet jogging mechanism of claim 19, wherein said backup means comprise a second articulated arm including pivotally interconnected forward and rear arm sections; second sheet edge contact means including forward and rear contact portions mounted by said second forward arm section; means for mounting said second rear arm section to swing toward a jogging position adjacent the opposite side of the sheet stack; and second arm control means for controlling relative pivotal movement of said second forward and rear arm sections such that said second forward contact portion first engages the sheet edges of the opposite side of the sheet stack as said second rear arm section is swung toward its jogging position, and then second forward and rear contact portions simultaneously engage the sheet edges of the opposite side of the sheet stack when said second rear arm section reaches its jogging position.

22. The sheet jogging mechanism of claim 21, wherein said second arm control means include means acting between said second arm sections for limiting relative pivotal movement thereof such that said second forward arm section (1) is prevented from swinging away from the opposite side of the sheet stack as said second rear arm section is swung toward its jogging position, and (2) is prevented from swinging relative to said second rear arm section when said second rear arm section reaches its jogging position.

* * * * *